US012692761B2

(12) United States Patent
Saoumi

(10) Patent No.: US 12,692,761 B2
(45) Date of Patent: Jul. 28, 2026

(54) WELLHEAD ATTACHMENT DEVICE

(71) Applicant: Fahmi Saoumi, Laval (CA)

(72) Inventor: Fahmi Saoumi, Laval (CA)

( * ) Notice: Subject to any disclaimer, the term of this patent is extended or adjusted under 35 U.S.C. 154(b) by 0 days.

(21) Appl. No.: 19/018,586

(22) Filed: Jan. 13, 2025

(65) Prior Publication Data

US 2025/0243725 A1 Jul. 31, 2025

Related U.S. Application Data

(60) Provisional application No. 63/627,195, filed on Jan. 31, 2024.

(51) Int. Cl.
*E21B 33/03* (2006.01)
*E21B 33/08* (2006.01)
*E21B 41/02* (2006.01)

(52) U.S. Cl.
CPC ..... *E21B 33/03* (2013.01); *E21B 33/08* (2013.01); *E21B 41/02* (2013.01)

(58) Field of Classification Search
CPC ..... E21B 33/03; E21B 33/08
See application file for complete search history.

(56) References Cited

U.S. PATENT DOCUMENTS 4,321,975 A * 3/1982 Dyer ..... E21B 33/06 166/88.1
4,665,976 A * 5/1987 Retherford ..... E21B 33/08 166/93.1
4,872,508 A * 10/1989 Gordon ..... F16J 15/004 166/96.1
5,137,083 A 8/1992 Bump
5,351,753 A * 10/1994 Golson ..... E21B 33/08 166/107
5,791,411 A 8/1998 Ricalton
6,637,509 B2 10/2003 Farquharson
9,828,823 B2 11/2017 Tan
11,261,687 B2 3/2022 Yu
2011/0232896 A1* 9/2011 Brewer ..... E21B 43/127 166/81.1
2016/0281478 A1* 9/2016 Brewer ..... E21B 43/127

* cited by examiner

*Primary Examiner* — David Carroll
(74) *Attorney, Agent, or Firm* — Brennan, Manna & Diamond, LLC

(57) ABSTRACT

The subject matter disclosed and claimed herein, in one embodiment thereof, comprises a Stri-Lube device. The device is a specialized component for sucker and polished rods, designed to reduce burning of stuffing box packing elements. The Stri-Lube device comprises a body component that supplies clean oil and inhibitors in the right quantities to reduce corrosion and costly damage. The body component features a cover that covers the internal chambers of lubricating oil and corrosion inhibitors underneath a stuffing box to connect with the wellhead. The device also features adjusting screws to tighten rubber gaskets and accommodate longer wear life. Thus, once the device is connected to a wellhead, clean oil and inhibitors in the correct quantities can be supplied to reduce corrosion, damage, and burning.

20 Claims, 3 Drawing Sheets

WELLHEAD ATTACHMENT DEVICE

CROSS-REFERENCE TO RELATED APPLICATION

The present application claims priority to, and the benefit of, U.S. Provisional Application No. 63/627,195, which was filed on Jan. 31, 2024, and is incorporated herein by reference in its entirety.

FIELD OF THE INVENTION

The present invention relates generally to the field of wellhead attachment devices, namely a Stri-Lube device. More specifically, the present invention relates to a specialized component that supplies clean oil and inhibitor material to machinery while reducing the burning of stuffing box packing elements. Accordingly, this disclosure makes specific reference thereto the present invention. Nonetheless, it is to be appreciated that aspects of the present invention are also equally applicable to other like applications, devices and methods of manufacture.

BACKGROUND

By way of background, this invention relates to significant advancements in wellhead attachment devices, which are critical components in oil production. Wellheads, being constantly exposed to harsh environmental conditions and corrosive materials, are prone to damage over time. Corrosion of the wellhead is a particular issue, as it can lead to leaks or spills of crude oil, which can be both environmentally hazardous and costly to remedy. Furthermore, the burning or excessive wear of stuffing box packing material, often caused by friction, heat, or contamination, can result in machinery failure or reduced operational efficiency. These issues have long plagued the oil industry, as traditional wellhead attachment devices lack the necessary protective features to address corrosion and packing material degradation. Compounding this issue, there is currently not widely available or cost-effective solution on the market capable of preventing such crude oil spills, corrosion-related damage, or the burning of stuffing box elements, leaving a significant gap in wellhead maintenance and protection.

Accordingly, there is a demand for an improved Stri-Lube device that prevents corrosion, damage, and crude oil spills. More particularly, there is a demand for a Stri-Lube device that supplies clean oil and inhibitor material to reduce corrosion and costly damage and reduces the burning of stuffing box packing elements.

Therefore, there exists a long-felt need in the art for a Stri-Lube device that provides users with a specialized component for sucker and polished rods designed to reduce the burning of stuffing box packing elements. There is also a long-felt need in the art for a Stri-Lube device that supplies clean oil and inhibitors in the right quantities to reduce corrosion and costly damage. Further, there is a long-felt need in the art for a Stri-Lube device that covers the chambers of lubricating oil and corrosion inhibitors underneath a stuffing box to connect with the wellhead. Moreover, there is a long-felt need in the art for a device that features adjusting screws to tighten rubber gaskets and accommodate longer wear life. Finally, there is a long-felt need in the art for a Stri-Lube device that saves considerable money for crude oil suppliers.

The subject matter disclosed and claimed herein, in one embodiment thereof, comprises a Stri-Lube device. The device is a specialized component for sucker and polished rods, designed to reduce burning of stuffing box packing elements. The Stri-Lube device comprises a body component that supplies clean oil and inhibitors in the right quantities to reduce corrosion and costly damage. The body component features a cover that covers the internal chambers of lubricating oil and corrosion inhibitors underneath a stuffing box to connect with the wellhead. The device also features adjusting screws to tighten rubber gaskets and accommodate longer wear life. Thus, once the device is connected to a wellhead, clean oil and inhibitors in the correct quantities can be supplied to reduce corrosion, damage, and burning. Accordingly, the device saves considerable money for crude oil suppliers.

In this manner, the Stri-Lube device of the present invention accomplishes all of the forgoing objectives and provides users with a specialized component for sucker and polished rods designed to reduce burning of stuffing box packing elements.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a Stri-Lube device. The device is a specialized component for sucker and polished rods designed to reduce the burning of stuffing box packing elements. The Stri-Lube device comprises a body component with lube and inhibitor compartments. Thus, once the device is attached to a wellhead, it supplies clean oil and inhibitors in the correct quantities, reducing corrosion and costly damage.

In one embodiment, the Stri-Lube device of the present invention assists any wellhead where lubricant, inhibitor, and packing element are used. The Stri-Lube device secures easily to a wellhead and reduces the burning of packing elements. The Stri-Lube device provides for lubricant and inhibitor to be supplied in the correct quantities, as needed. The Stri-Lube device includes two internal compartments for lubricant and inhibitor, respectively.

In one embodiment, the Stri-Lube device comprises a body component. The body component is typically configured in a cylindrical shape but can be configured in any suitable shape as is known in the art. Typically, the body component comprises a cover, adjustable screws, a lube compartment, an inhibitor compartment, and a guide pipe.

In one embodiment, the body component acts as a container for lube and inhibitor, stored in respective compartments. The cover of the body component covers the lubricant and inhibitor and features adjustable screws with nuts that secure the cover in a removable fashion so that the lubricant and inhibitor can be refilled. The guide pipe is cylindrical in shape but features a smaller diameter than the wall of the body component, and acts as a separator between the lube and inhibitor fluids.

In one embodiment, the Stri-Lube device comprises a union connector. The union connector is comprised of a packing element, an open-end cap, a calibration handle, and a relief nipple. The packing element space of the union connector consists of a male relief nipple and a female open-end cap. The male relief nipple releases surplus fluid, and the female open-end cap is at the very top of the device through which a rod will enter. The packing element squeezes the rod to prevent spills. The calibration handle is tightened or released for calibration purposes.

In one embodiment, the Stri-Lube device comprises a stuffing box. The stuffing box acts as a connection to an oil wellhead and features a tightening handle. The tightening handle acts as a means of attachment to an oil wellhead.

In one embodiment, the Stri-Lube device in accordance with the present invention can be produced in various colors, designs, patterns, etc., and feature logos, emblems, and or designs, such as a facility requests and/or a user desires.

In one embodiment, the Stri-Lube device is manufactured of a steel, or any other suitable materials as is known in the art. Any number of different types of materials can be used to make the Stri-Lube device including but not limited to carbon steel, metal alloys, etc.

In use, the user adds lubricant and inhibitor to the respective compartments inside the body component. Further, the user connects the device to a wellhead. Finally, the user utilizes the device while drilling for oil to reduce the burning of stuffing box packing elements. Thus, once the device is connected to a wellhead, clean oil and inhibitors in the correct quantities can be supplied to reduce corrosion, damage, and burning. The device covers the chambers of lubricant and corrosion inhibitor underneath a stuffing box to connect with the wellhead, features adjusting screws to tighten rubber gaskets and accommodate longer wear life and saves considerable money for crude oil suppliers.

It will also be appreciated that there are a number of additional add-on features that can be incorporated into the device and moreover, the Stri-Lube device can take many different forms as is known in the art.

In yet another embodiment, the Stri-Lube device comprises a plurality of indicia.

In yet another embodiment, a method of conveniently reducing the burning of stuffing box packing elements is disclosed. The method includes the steps of providing a Stri-Lube device comprising a body component, and a stuffing box. The method also comprises adding lubricant and inhibitor to the respective compartments inside the body component. Further, the method comprises connecting the device to a wellhead. Finally, the method comprises utilizing the device while drilling for oil to reduce the burning of stuffing box packing elements.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
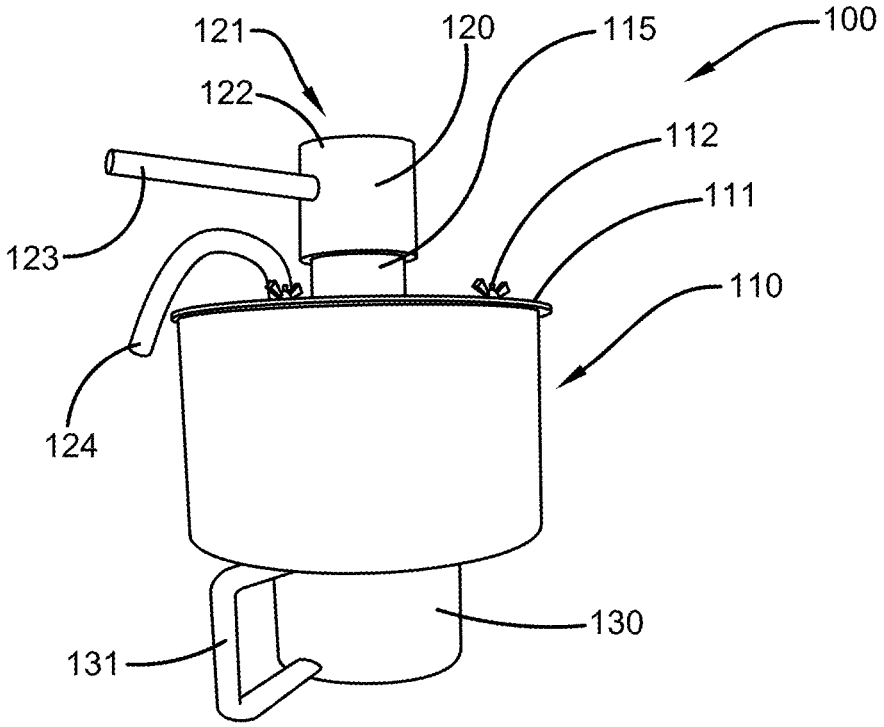
FIG. 1 illustrates a perspective view of one embodiment of the Stri-Lube device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a Stri-Lube device that provides users with a specialized component for sucker and polished rods designed to reduce the burning of stuffing box packing elements. There is also a long-felt need in the art for a Stri-Lube device that supplies clean oil and inhibitors in the right quantities to reduce corrosion and costly damage. Further, there is a long-felt need in the art for a Stri-Lube device that covers the chambers of lubricating oil and corrosion inhibitors underneath a stuffing box to connect with the wellhead. Moreover, there is a long-felt need in the art for a device that features adjusting screws to tighten rubber gaskets and accommodate longer wear life. Finally, there is a long-felt need in the art for a Stri-Lube device that saves considerable money for crude oil suppliers.

The present invention, in one exemplary embodiment, comprises a Stri-Lube device. The device is a specialized component for sucker and polished rods, designed to reduce burning of stuffing box packing elements. The Stri-Lube device comprises a body component that supplies clean oil and inhibitors in the right quantities to reduce corrosion and costly damage. The body component features a cover that covers the internal chambers of lubricating oil and corrosion inhibitors underneath a stuffing box to connect with the wellhead. The device also features adjusting screws to tighten rubber gaskets and accommodate longer wear life. Thus, once the device is connected to a wellhead, clean oil and inhibitors in the correct quantities can be supplied to reduce corrosion, damage, and burning. Accordingly, the device saves considerable money for crude oil suppliers. The present invention also includes a novel method of conveniently reducing the burning of stuffing box packing elements while drilling for oil. The method includes the steps of providing a Stri-Lube device comprising a body component, and a stuffing box. The method also comprises adding lubricant and inhibitor to the respective compartments inside the body component. Further, the method comprises connecting the device to a wellhead. Finally, the method comprises utilizing the device while drilling for oil to reduce the burning of stuffing box packing elements.

Referring initially to the drawings, FIG. 1 illustrates a perspective view of one embodiment of the device 100 of the present invention. In this embodiment, the device 100 is designed specifically for use with sucker and polished rods, which are critical components in oil well operations. The device 100 is configured to provide enhanced lubrication and corrosion protection, significantly reducing the risk of burning or degrading the stuffing box packing elements during operation. The packing elements are essential for maintaining a proper seal around the rod as it moves through the wellhead. Specifically, the device 100 comprises a body component 110 that houses two primary chambers: at least one lube compartment 113 and at least one inhibitor compartment 114. These compartments work in tandem to supply clean oil and corrosion inhibitors in precise quantities, ensuring that the wellhead components remain well-lubricated and protected from the harsh conditions that typically cause wear and corrosion. Once the device 100 is securely connected to the wellhead, it automatically delivers these substances as needed to prevent mechanical damage, crude oil spills, and the burning of the stuffing box elements, ultimately enhancing the overall efficiency and safety of the wellhead system.

The body component 110 of the device 100 also features several key structural components, including a cover 111, screws 112, and a guide pipe 115. The cover 111 is designed to securely fasten to the body component 110 through the use of adjustable screws 112, which allow for easy removal or tightening when maintenance or refilling of the lube and inhibitor compartments is required. The guide pipe 115 plays a crucial role in separating the lube compartment 113 from the inhibitor compartment 114, ensuring that the two substances do not mix and are delivered in the correct proportions. This separation is vital for the proper functioning of the device, as the oil and inhibitor materials serve different purposes within the wellhead, and their independent application is necessary for optimal performance.

In addition to the body component, the device 100 includes a union connector 120 that is essential for connecting the device to the wellhead and ensuring a tight, leak-proof seal. The union connector 120 comprises several subcomponents, including a packing element 121, an open-end cap 122, a calibration handle 123, and a relief nipple 124. The packing element 121, located within the union connector 120, functions as a sealing mechanism that grips the rod as it passes through the wellhead, preventing any fluid leaks. The open-end cap 122, positioned at the top of the device, provides an entry point for the rod and is designed to be easily removed for maintenance purposes. The calibration handle 123 allows users to adjust the tension of the packing element 121, ensuring that it maintains an optimal seal without exerting too much pressure on the rod. The relief nipple 124, an essential safety feature, automatically releases any excess fluid that may accumulate within the device, preventing pressure build-up that could lead to leaks or equipment damage.

The stuffing box 130, another critical component of the device 100, serves as the primary connection point between the device and the oil wellhead. The stuffing box 130 is equipped with a tightening handle 131, which allows users to securely attach the device to the wellhead and adjust the tension as necessary to maintain a leak-proof connection. This handle ensures that the device remains firmly in place during operation, even under high-pressure conditions, and can be easily loosened for removal or maintenance.

Figure 2:
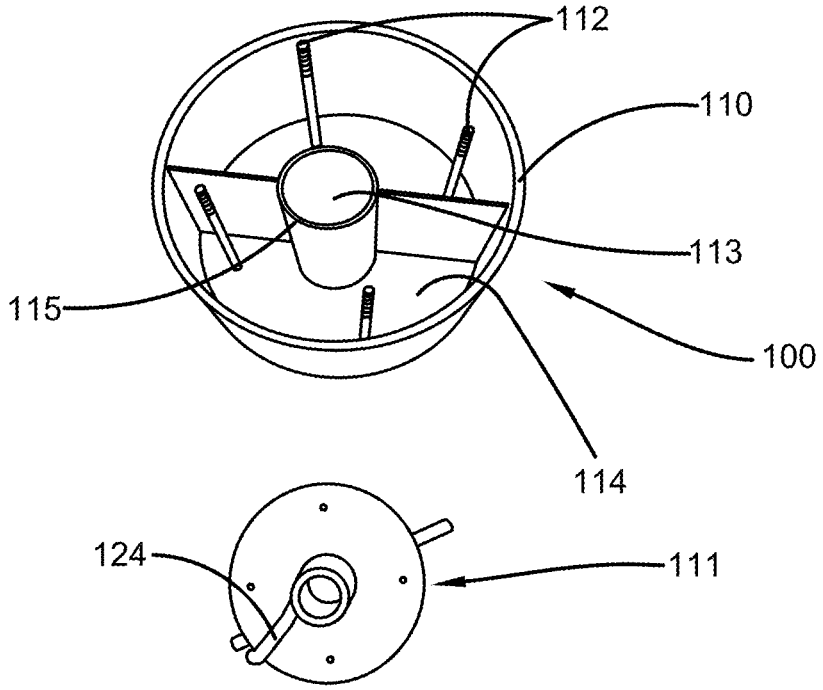
FIG. 2 illustrates a perspective view of one embodiment of the Stri-Lube device of the present invention showing the inside of the body component in accordance with the disclosed architecture.

As shown in FIG. 2, the body component 110 of the device 100 is typically configured in a cylindrical shape to facilitate a snug fit around the rod and wellhead. However, the device 100 can be manufactured in various shapes and sizes depending on the specific requirements of the wellhead system and the preferences of the user. The cover 111, which is usually circular, is designed to fit securely over the top of the body component 110, protecting the internal components from dust, debris, and environmental contaminants.

Figure 3:
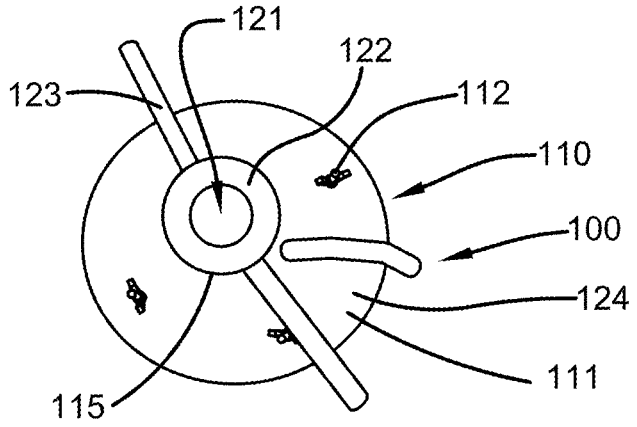
FIG. 3 illustrates a perspective view of one embodiment of the Stri-Lube device of the present invention from the top of the device in accordance with the disclosed architecture.
Figure 4:
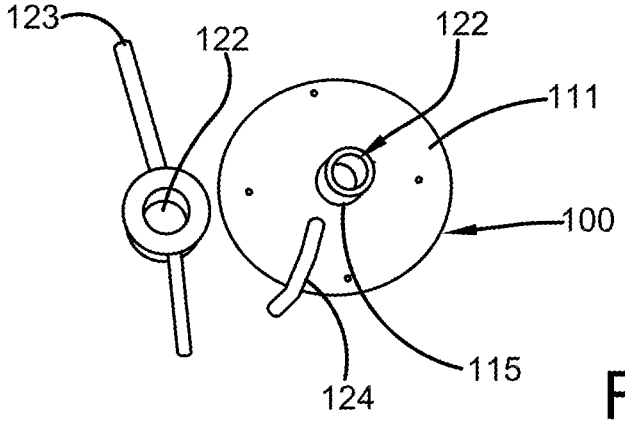
FIG. 4 illustrates a perspective view of one embodiment of the Stri-lube device of the present invention showing the calibration handle and cover of the device in accordance with the disclosed architecture.

FIGS. 3 and 4 provide additional perspective views of the device 100, focusing on the top portion of the device. These figures highlight the open-end cap 122, calibration handle 123, and relief nipple 124, all of which are essential for the proper operation and maintenance of the device. The open-end cap 122 serves as the primary entry point for the rod, while the calibration handle 123 allows for precise adjustments to the tension of the packing element 121, ensuring a proper seal. The relief nipple 124, located near the top of the device, releases any surplus fluid to prevent overflow or pressure build-up, ensuring that the device operates smoothly and without interruption.

Figure 5:
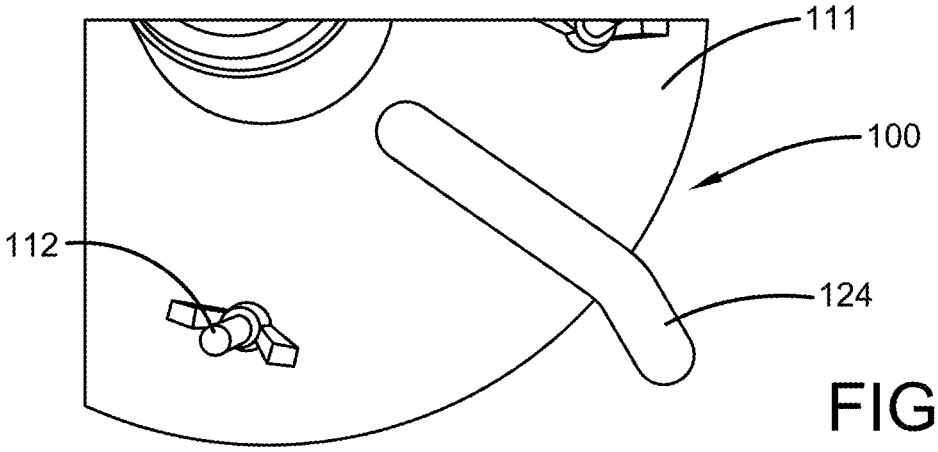
FIG. 5 illustrates a perspective view of one embodiment of the Stri-Lube device of the present invention showing the male relief nipple on the cover of the device in accordance with the disclosed architecture.
Figure 6:
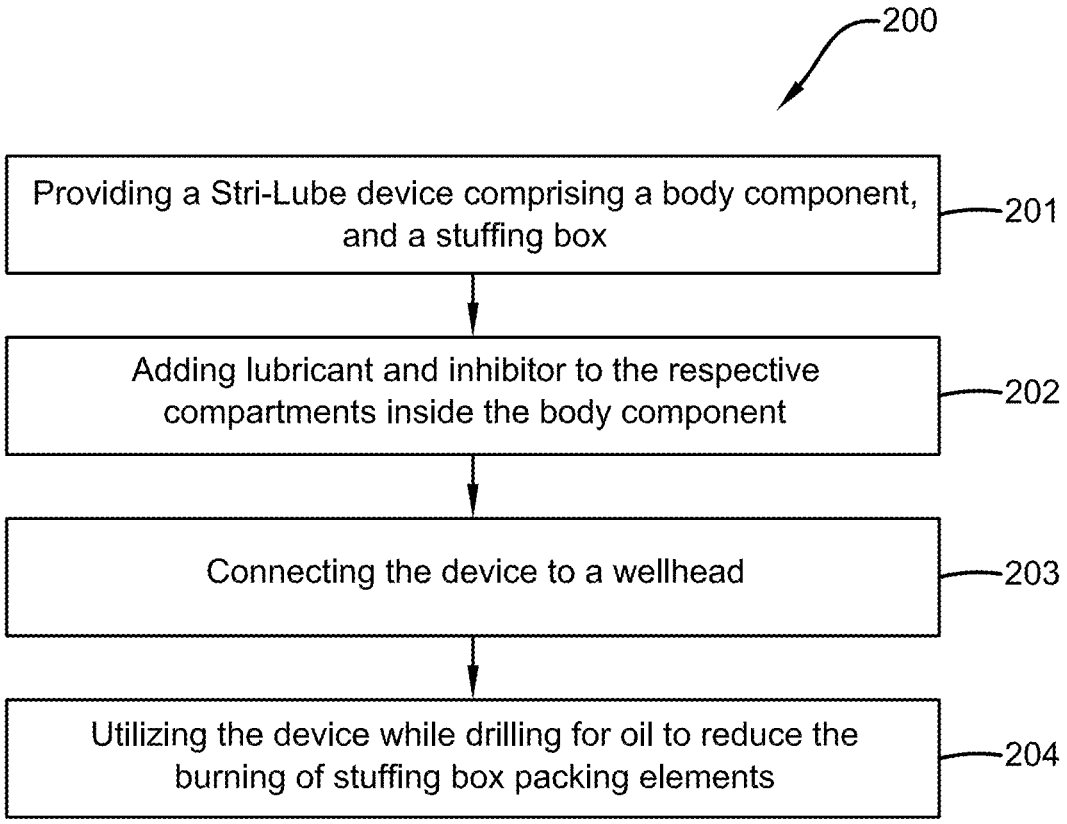
FIG. 6 illustrates a flowchart showing the method of conveniently reducing the burning of stuffing box packing elements while drilling for oil in accordance with the disclosed architecture.

FIG. 5 illustrates a close-up perspective view of the male relief nipple 124, which is located on the cover 111 of the device 100. This relief nipple 124 is designed to release any excess fluid that may accumulate within the device during operation, preventing the device from overflowing or becoming clogged. The proper functioning of the relief nipple 124 is essential to maintaining the overall integrity and efficiency of the device.

It is to be appreciated that the device 100, in accordance with the present invention, can be produced in various colors, designs, patterns, and finishes, allowing for customization to suit the preferences of the user or the branding requirements of a facility. The device may also feature logos, emblems, or other decorative elements as requested.

In one embodiment, the device 100 is manufactured from high-strength steel or other suitable materials known in the art. These materials include, but are not limited to, carbon steel, metal alloys, heat-scalable plastics, and polymers such as polypropylene, acrylonitrile-butadiene-styrene (ABS), or other durable materials like acrylic, polycarbonate, polyethylene, polyethylene terephthalate, and polyvinyl chloride. The materials selected for the device 100 are designed to be water-resistant or waterproof, ensuring the durability and longevity of the device in harsh environmental conditions.

In yet another embodiment, the device 100 may incorporate various types of indicia 400, such as advertising, trademarks, or other letters, designs, or characters, which may be printed, painted, stamped, or otherwise integrated into the body component 110. These indicia 400 can include logos, emblems, images, symbols, or any other design elements that may be oil-related or specific to a company's branding.

It will also be appreciated that the device 100 could be modified to include additional features, configurations, or attachments depending on the specific needs of the user or the application. This flexibility ensures that the device can be tailored to suit a wide range of wellhead systems and operational requirements.

FIG. 3 illustrates a flowchart of the method 200 of conveniently reducing the burning of stuffing box packing elements. The method includes the steps of at 201, providing a Stri-Lube device comprising a body component, and a stuffing box. The method also comprises at 202, adding lubricant and inhibitor to the respective compartments inside the body component. Further, the method comprises at 203, connecting the device to a wellhead. Finally, the method comprises at 204, utilizing the device while drilling for oil to reduce the burning of stuffing box packing elements.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "Stri-Lube device", "wellhead device", "stuffing box device", and "device" are interchangeable and refer to the Stri-Lube device 100 of the present invention.

Notwithstanding the forgoing, the Stri-Lube device 100 of the present invention can be of any suitable size and configuration as is known in the art without affecting the overall concept of the invention, provided that it accomplishes the above stated objectives. One of ordinary skill in the art will appreciate that the Stri-Lube device 100 as shown in FIGS. 1 and 2 is for illustrative purposes only, and that many other sizes and shapes of the Stri-Lube device 100 are well within the scope of the present disclosure. Although the dimensions of the Stri-Lube device 100 are important design parameters for user convenience, the Stri-Lube device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A device comprising:

a body component configured to be connected to a wellhead;

a lube compartment and an inhibitor compartment housed within the body component, wherein the lube compartment and the inhibitor compartment are separated by a guide pipe to prevent the mixing of substances; and a union connector for securely attaching the device to the wellhead, the union connector comprising a packing element.

2. The device of claim 1, wherein the body component is comprised of a cylindrical shape.

3. The device of claim 1 comprised of a cover.

4. The device of claim 3, wherein the cover attaches to the body component via an adjustable screw.

5. The device of claim 1, wherein the union connector is comprised of a calibration handle.

6. The device of claim 5, wherein the calibration handle adjusts a tension of the packing element.

7. The device of claim 1 further comprised of a stuffing box.

8. A device comprising:

a body component comprising:

a cover attached to the body component by a screw;

a lube compartment and an inhibitor compartment separated by a guide pipe; and a union connector attached to the body component, the union connector comprised of a packing element, an open-end cap, a calibration handle for adjusting a tension of the packing element, and a relief nipple.

9. The device of claim 8, wherein the body component is comprised of a steel material.

10. The device of claim 8 further comprised of a tightening handle.

11. The device of claim 8, wherein the packing element is comprised of an oil-resistant material.

12. The device of claim 8, wherein the relief nipple is positioned on the cover.

13. The device of claim 8, wherein the screw is comprised of an adjustable screw.

14. A device comprising:

a body component;

an indicia;

a cover attached to the body component by a screw;

a lubrication compartment and at least one corrosion inhibitor compartment separated by a guide pipe; and a union connector comprising a packing element, an open-end cap, and a relief nipple, wherein the device is configured to automatically deliver lubrication and corrosion inhibitors to wellhead components to prevent stuffing box packing element damage, fluid leaks, and pressure build-up.

15. The device of claim 1, wherein the screw is comprised of an adjustable screw.

16. The device of claim 14, wherein the stuffing box is comprised of a tightening handle.

17. The device of claim 14, wherein the cover is comprised of a circular cover.

18. The device of claim 14, wherein the device is comprised of a steel material.

19. The device of claim 18, wherein the steel material is comprised of a carbon steel or a metal alloy.

20. The device of claim 14, wherein the device is comprised of a heat-sealable plastic material.

* * * * *